US005857264A

United States Patent [19]

Debolini

[11] Patent Number: 5,857,264

[45] Date of Patent: Jan. 12, 1999

[54] DRYER, PARTICULARY FOR GRANULAR OR POWDERED PRODUCTS

[76] Inventor: Paolo Debolini, c/o Italvacuum S.r.l., Via Stroppiana 3, I-10071 Borgano Torinese (Torino), Italy

[21] Appl. No.: 722,004

[22] PCT Filed: Mar. 15, 1995

[86] PCT No.: PCT/EP95/00959

§ 371 Date: Sep. 30, 1996

§ 102(e) Date: Sep. 30, 1996

[87] PCT Pub. No.: WO95/27181

PCT Pub. Date: Oct. 12, 1995

[30] Foreign Application Priority Data

Mar. 31, 1994 [IT] Italy ..... TO94A0243

[51] Int. Cl.[6] ..... F26B 11/12

[52] U.S. Cl. ..... 34/179; 366/288

[58] Field of Search ..... 34/179, 180, 183; 366/288, 312

[56] References Cited

U.S. PATENT DOCUMENTS

| | | | |
|---|---|---|---|
| 2,552,360 | 5/1951 | Zichis | 34/179 |
| 2,732,186 | 6/1956 | Ivarsson . | |
| 3,855,404 | 12/1974 | Rotaru . | |
| 4,183,673 | 1/1980 | Kimmel | 366/288 |
| 4,506,838 | 3/1985 | Riniker et al. . | |
| 4,882,851 | 11/1989 | Wennerstrum et al. . | |
| 5,150,968 | 9/1992 | Inoue | 366/288 |

FOREIGN PATENT DOCUMENTS

| | | |
|---|---|---|
| 54-132298 | 12/1979 | Japan . |
| 1345000 | 1/1974 | United Kingdom . |

*Primary Examiner*—Henry A. Bennett
*Assistant Examiner*—Malik N. Drake
*Attorney, Agent, or Firm*—Sughrue, Mion, Zinn, Macpeak & Seas, PLLC

[57] ABSTRACT

The dryer includes a double-walled casing, the inner wall of which defines a cylindrical drying chamber for receiving the products and the outer wall and the inner wall of which define between them an interspace for the circulation of a diathermic fluid. A shaft is mounted in the chamber and has a motor for rotating it about its own axis and at least one blade fixed to it which, on rotation of the shaft, can exert a mixing action on the product and can detach it from the inner wall of the casing. The shaft is mounted eccentrically of the longitudinal axis of the chamber and has a motor rotating it about the longitudinal axis of the chamber.

10 Claims, 4 Drawing Sheets

DRYER, PARTICULARY FOR GRANULAR OR POWDERED PRODUCTS

BACKGROUND OF THE INVENTION

The present invention relates to a dryer, particularly for granular or powdered products, which includes:

double-walled casing, the inner wall of which defines a cylindrical drying chamber for the aforesaid products and the outer and inner walls of which define between them an interspace for the circulation of a diathermic fluid, and a shaft mounted in the chamber and having means for enabling it to rotate about its own axis, at least one blade being securely fixed to the shaft and operable, on rotation of the latter, to exert a mixing action on the products and to detach them from the inner wall of the casing.

In prior art dryers of the above type the shaft is mounted so that it projects into the drying chamber with its axis coincident with that of the chamber.

Since the blades fixed to the shaft must extend close to the inner wall of the casing to carry out an effective scraping action, the overall diameter of the rotary members is substantially the same as the inner diameter of the drying chamber.

Hence, if the latter is rather large, the rotary members must be large and heavy, thus placing limitations on the performance of the dryer which, in some cases, are quite considerable.

For example, the speed of rotation of the shaft must not exceed certain values in order to avoid causing excessive twisting and bending stresses, thus limiting the effectiveness of the mixing.

In addition, significant clearance must be maintained between the facing surfaces of the distal ends of the blades and the inner wall of the chamber to prevent the machine from seizing up as a result of heat expansion or deformation caused by mechanical stress on the rotary members.

As a result, a significant layer of the material to be dried builds up on the inner wall of the chamber as the blades are unable to detach it and this behaves like a layer of insulation towards the diathermic fluid circulating in the interspace, thereby compromising the efficiency of the heat exchange in the dryer to a certain extent.

SUMMARY OF THE INVENTION

In order to overcome the above disadvantages, the present invention provides a dryer of the above type, characterised in that the shaft is mounted eccentrically of the longitudinal axis of the chamber and has means for enabling it to rotate about the longitudinal axis of the chamber.

According to the invention, the overall diameter of the rotary members is therefore considerably smaller than that of the drying chamber, for example, of the order of about one half, thereby considerably reducing their moments of inertia and mass compared with those of rotary members of prior art dryers with diameters substantially the same as that of the drying chambers.

The shaft of the dryer of the invention thus offers the advantage of being able to rotate at a far higher angular velocity, even an order of magnitude higher, than that of the shafts of the prior art dryers described above, thereby improving the mixing of the products in the drying chamber.

In addition, the reduction in heat expansion and deformation due to mechanical stress resulting from the reduced diameter of the rotary members enables the necessary clearances between the ends of the blades and the inner wall of the drying chamber to be reduced, thus ensuring efficient scraping and improving the heat exchange between the diathermic fluid and the inside of the chamber.

Furthermore, in any operating condition, only one region of the outer circumference of each cross-section of the rotary members of the dryer of the invention is adjacent the inner wall of the drying chamber, with the advantages that the operations required to mount and dismantle the rotary members are simplified considerably and it is almost impossible for them to jam against the inner wall of the chamber.

In a preferred embodiment of the dryer of the invention, the means for enabling the shaft to rotate about the axis of the chamber and about its own axis are independent of each other.

This means that, when, for example, the dryer is started up, it is possible to rotate the shaft about its own axis only, it being held in the upper portion of the chamber so that it is only partly immersed in the material to be dried which is normally in the central and lower parts of the chamber.

Thus, the means for rotating the shaft, usually an electric motor, are not subjected to excessive starting stresses.

At a later stage it is possible to start the shaft rotating about the axis of the chamber as well so that the rotary members are entirely immersed in the product to be dried at each rotation.

The effort demanded of the drive means is certainly less than that which would have been required to cause a similar movement in the start-up phase since the granular product has already been partially dried and is thus less sticky, offering less resistance to the mixing action of the blades.

BRIEF DESCRIPTION OF THE DRAWINGS

Further advantages and characteristics of the present invention will become apparent from the detailed description which follows, given with reference to the appended drawings, provided purely by way of non-limitative example, in which.

DETAILED DESCRIPTION OF THE INVENTION

Figure 1:
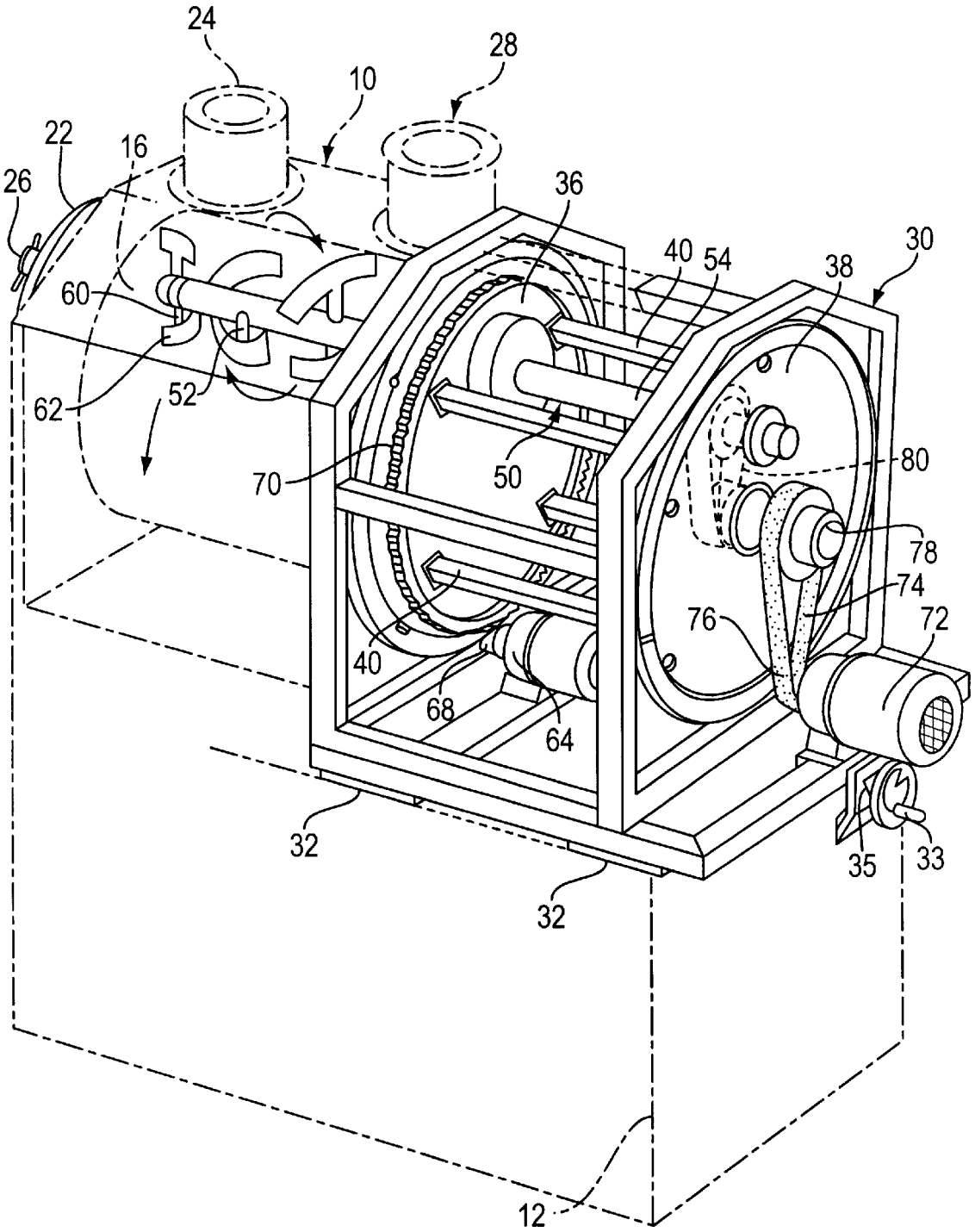
FIG. 1 is a perspective view of the dryer of the invention.
Figure 2:
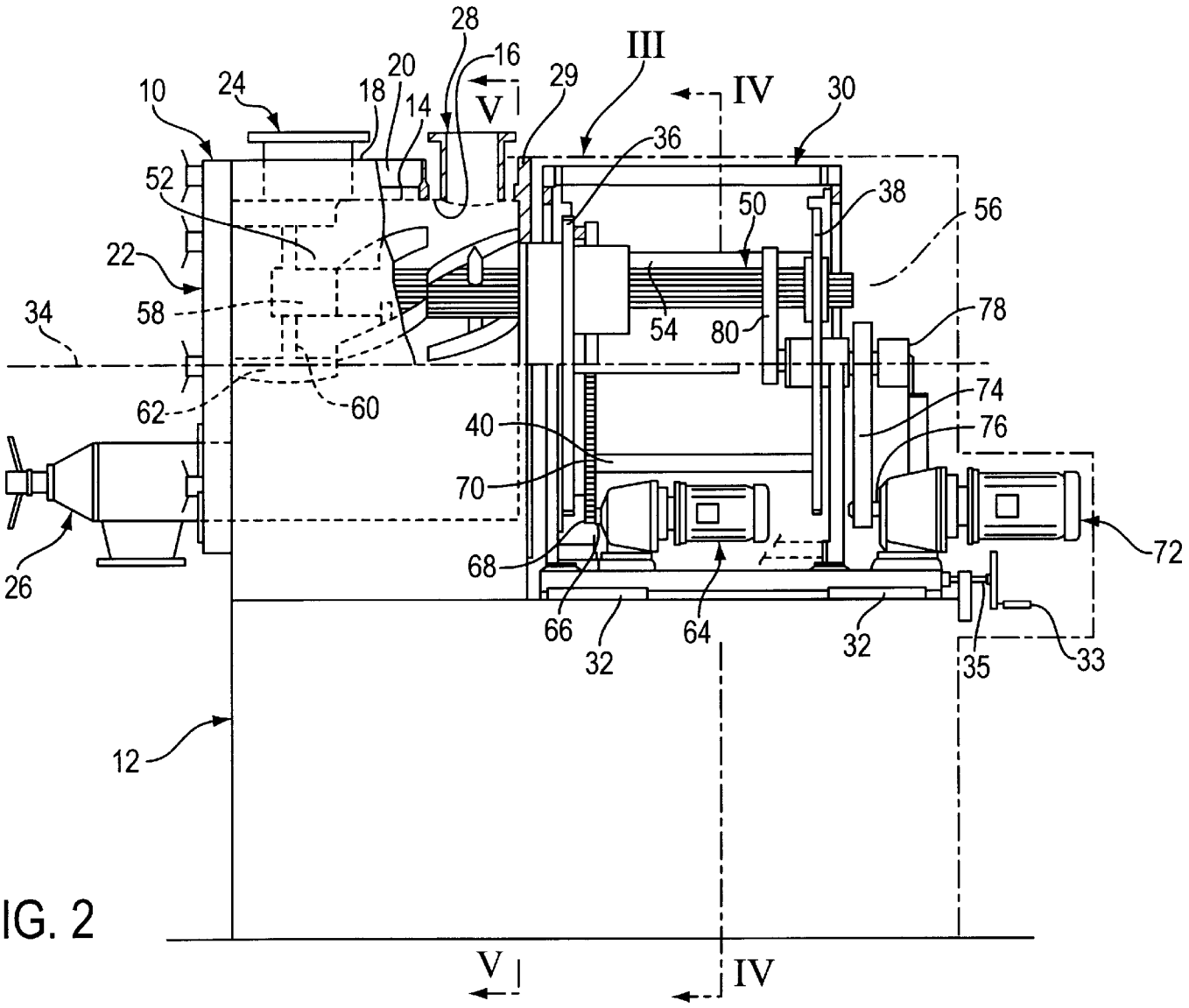
FIG. 2 is a side elevational view of the dryer of FIG. 1.

A dryer, particularly for granular or powdered products, includes (FIGS. 1 and 2) a double-walled casing 10 fixed to a base 12.

The inner wall 14 of the casing 10 defines a cylindrical drying chamber 16 for receiving the granular products. The outer wall 18 and the inner wall 14 of the casing 10 define between them an interspace 20 for the circulation of a diathermic fluid.

The casing is also provided, in known manner, with an openable hatch 22 which constitutes an end wall of the cylindrical structure, a loading hopper 24 and an outlet 26 and a duct 28 for connection to suction means.

Outside the end wall 29 of the cylindrical casing 10 opposite the hatch 22, an openwork support frame 30 is slidable on guides 32 fixed to the base 12. A handwheel 33 mounted on the base 12 controls the rotation of a screw 35 engaged with a threaded element (not shown in the drawings) formed in the frame 30 to enable this to be moved.

First and second parallel discs 36 and 38 are mounted spaced from each other on the frame 30 for rotation about an axis 34 coincident with that of the chamber 16. The two discs 36, 38 are connected by reinforcement bars 40.

Figure 3:
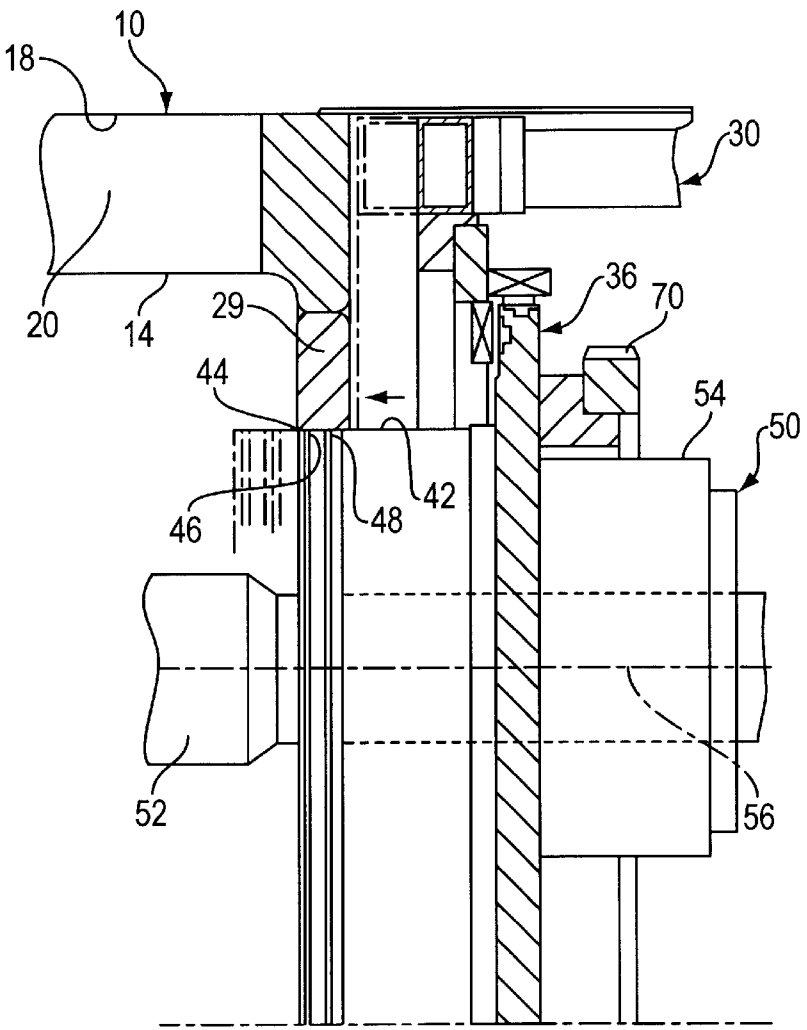
FIG. 3 is an enlarged view of a detail of FIG. 2.

On its surface facing the casing 10, the first disc 36 (FIG. 3) has a projecting portion 42 inserted in an aperture 44 of corresponding dimensions formed in the wall 29 of the casing 10.

Two seals 46, 48 form a seal between the facing surfaces of the aperture 44 and the projecting portion 42 of the first disc 36.

Figure 5:
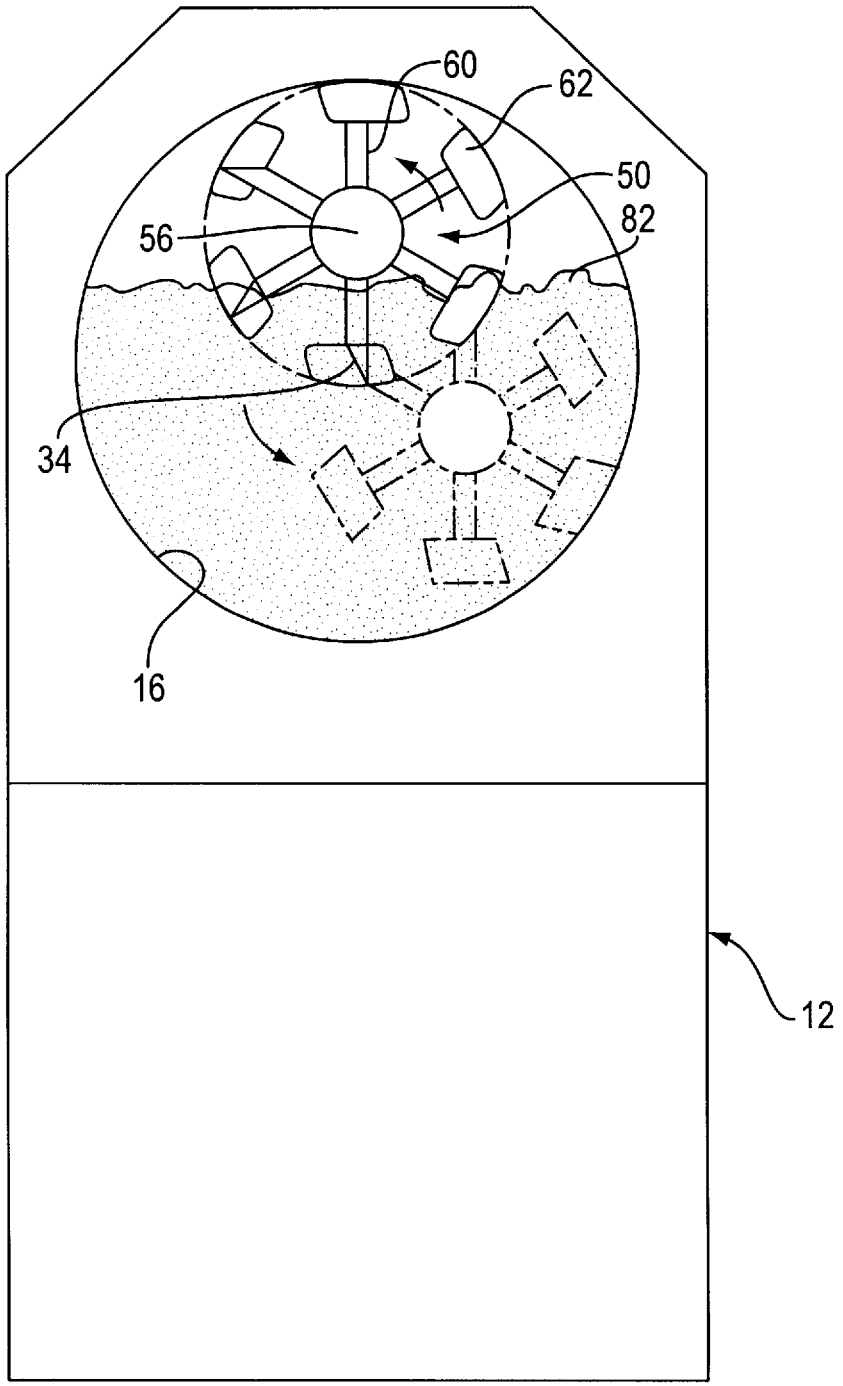
FIG. 5 shows a section taken on the line V—V of FIG. 2.

A shaft 50 (FIGS. 1, 2 and 5) having a first portion 52 projecting into the chamber 16, has a second portion 54 supported for rotation by the two discs 36, 38 which are substantially perpendicular to the axis 56 of the shaft 50. The axis 56 is parallel to and offset from the axis 34 of the discs 36, 38 and the casing 10.

A plurality of sleeves 58 are keyed to the first portion 52 of the shaft 50 and each has a pair of pins 60 projecting radially from diametrically opposite regions thereof, each pin supporting a helical blade 62.

The length of the pins 60 is such that, at a particular angle of rotation about the axis 56, the blades 62 extend almost to the inner wall 14 of the casing 10 so that they can mix the granular product and detach it from the wall 14, as will be clear from the description of their operation which follows. The diameter of the assembly constituted by the first portion 52 of the shaft 50, the pins 60 and the blades 62 is preferably of the order of about half that of the cylindrical chamber 16.

Figure 4:
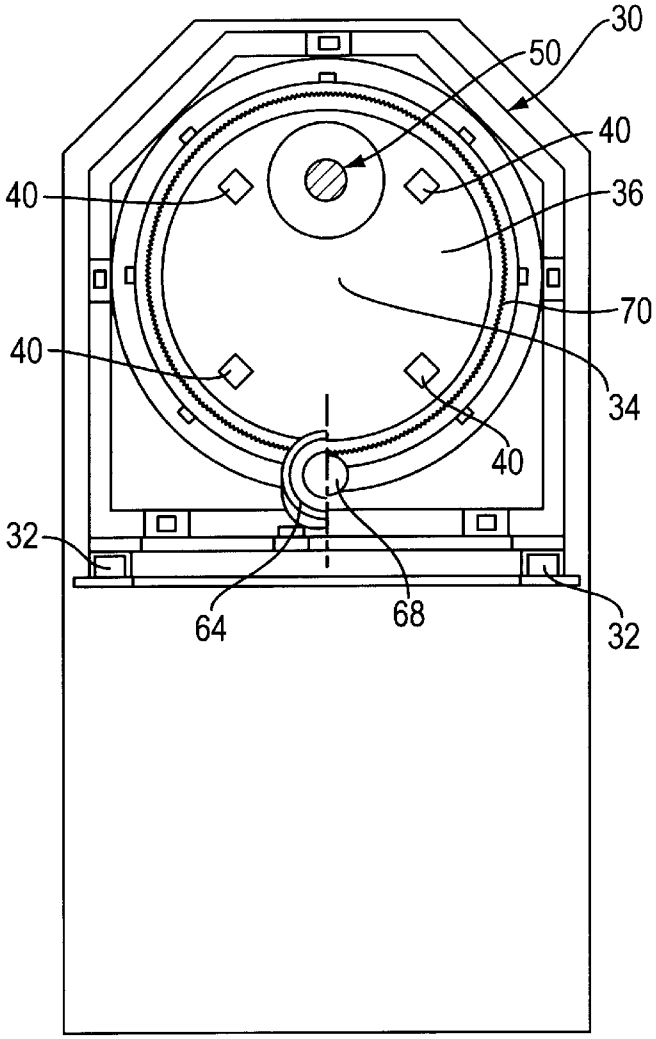
FIG. 4 shows a section taken on the line IV—IV of FIG. 2.

A first geared motor 64 is mounted on the frame 30 (FIGS. 1, 2 and 4) and has an output shaft 66 with a opinion 68 keyed thereon which can mesh with a gear 70 fixed to the first disc 36 to cause the two discs 36, 38 and the shaft 50 supported thereby to rotate about the axis 34.

A second geared motor 72 is also mounted on the frame 30 and is connected by a drive transmission to the second portion 54 of the shaft 50 so as to rotate it about its axis 56.

This transmission includes a first belt 74 connecting the output shaft 76 of the second geared motor 72 to an intermediate shaft 78 supported by the second disc 38 for rotation about an axis 34 coincident with that of the drying chamber 16, and a second belt 80 connecting the intermediate shaft 78 to the second portion 54 of the shaft 50.

In operation of the dryer, after the drying chamber 10 has been filled up to about 70% of its volume with a granular product 82 (FIG. 5) and a vacuum has been created therein, the diathermic fluid is circulated through the interspace 20 and the shaft 50 is rotated about its axis 56 by the second geared motor 72 and its associated drive transmission.

If care is taken to position the second portion 54 of the shaft 50 in the upper part of the chamber 16 (as indicated by the solid line of FIG. 5), the stress transmitted by the granular product 82, which in this initial phase is very moist and therefore sticky, is kept low since only some portions of the blades 62 are immersed in the product 82.

After a while, the first geared motor 64 may be started to cause the discs 36, 38 and, hence, the shaft 50 to rotate about the axis 34 thanks to the pinion 68 and the gear 70. During each full rotation of the discs 36, 38, the blades 62 fixed to the shaft 50 are totally immersed in the granular product 82 and act to detach any granular product 82 adhering to the inner wall 14 over its entire circumference.

The mixing action of the shaft 50 is promoted by the different helical profiles of the individual blades 62 which not only rotate the product 82 but cause it to move parallel to the axis 34 of the chamber 16 in both directions.

Naturally, depending on requirements, it is possible to rotate the shaft 50 about its own axis 56 and about the axis 34 of the chamber 16 in any desired combination of movements.

Maintenance of the dryer of the invention is very simple. By means of the handwheel 33 (FIGS. 1 and 2) it is possible to slide the frame 30 along the guides 32 to the left (as shown by the broken line of FIG. 3), disengaging the faced surfaces of the projecting portion 42 of the first disc 36 and of the aperture 44 in the casing 10.

When the type of product to be dried is changed, it is thus possible to clean the seals 44, 46 as well as the inner wall 14 of the chamber 16 very thoroughly, as necessary, for example, in the processing of pharmaceutical products for which absolute guarantees of purity and sterility are required.

It is naturally understood that, so long as the principles of the invention remain unchanged, constructional details and embodiments of the invention may vary widely from those described purely by way of non-limitative example without departing thereby from the scope of the present invention.

What is claimed is:

1. A dryer for granular products (82), including:

a double-walled casing (10), the inner wall (14) of which defines a cylindrical drying chamber (16) for receiving the products (82) and the outer wall (18) and the inner wall (14) of which define between them an interspace (20) for the circulation of a diathermic fluid, and a shaft (50) mounted in the chamber (16) and having means for enabling it to rotate about its own axis (56), at least one blade (62) being fixed to the shaft (50) and operable, on rotation of the shaft (50), to exert a mixing action on the products (82) and to detach them from the inner wall (14) of the casing (10), the shaft (50) being mounted eccentrically of the longitudinal axis (34) of the chamber (16) and having means for enabling it to rotate about the longitudinal axis (34) of the chamber (16), the dryer being characterised in that the shaft (50) has a first portion (52) projecting into the chamber (16) and a second portion (54) outside the chamber (16) and supported for rotation by at least a first plate (36) substantially perpendicular to the axis (56) of the shaft (50), said first plate (36) being mounted on a support frame (30) and provided with means for rotation about an axis (34) coincident with that of the drying chamber (16), a projecting portion (42) on one surface of this first plate (36) engaging an aperture (44) of corresponding dimensions formed in an end wall (29) of the casing (10).

2. A dryer according to claim 1, characterised in that the means for enabling the shaft (50) to rotate about the axis (34) of the chamber (16) and about its own axis (56) are independent of each other.

3. A dryer according to claim 1, characterised in that the first plate (36) has a projecting portion (42) on one surface which can engage the aperture (44) formed in the end wall (29) of the casing (10).

4. A dryer according to claim 1, characterised in that at least one seal (46, 48) ensures a seal between the facing surfaces of the aperture (44) and the projecting portion (42) of the first plate (36).

5. A dryer according to claim 2, characterised in that it includes a first geared motor (64) supported by the frame (30) and having an output shaft (66) on which is keyed a pinion (68) which can mesh with a gear (70) fixed to the first plate (36).

6. A dryer according to claim 1, characterized in that it includes the first plate (36) and a second plate (38) mounted for rotation on the support frame (30) and spaced from each other.

7. A dryer according to claim 5, characterized in that it includes a second geared motor (72) supported by the frame (30) and connectd by a transmission mechanism to the second portion (54) of the shaft (50) so as to rotate it about its own axis (56).

8. A dryer according to claim 7, characterised in that the transmission mechanism includes a first belt (74) connecting the output shaft (76) of the second geared motor (72) to an intermediate shaft (78) supported by a second plate (38) for rotation about an axis (34) coincident with that of the drying chamber (16), and a second belt (80) connecting the intermediate shaft (78) to the second portion (54) of the shaft (50).

9. A dryer according to claim 1, characterized in that the support frame (30) is slidably mounted on guides (32) fixed to a base (12) which also supports the casing (10).

10. A dryer according to claim 1, characterized in that a plurality of sleeves (58) are keyed to the first portion (52) of the shaft (50), each sleeve having a pair of pins (60) projecting radially from diametrically opposite regions thereof and each pin supporting a respective helical blade (62).

* * * * *